US009321092B2

(12) United States Patent
Takasue et al.

(10) Patent No.: US 9,321,092 B2
(45) Date of Patent: Apr. 26, 2016

(54) METHOD FOR FORMING STEEL SHEET BY HOT PRESSING

(75) Inventors: Tekkan Takasue, Hiroshima (JP); Kyousou Ishida, Hiroshima (JP); Kouji Hironaka, Hiroshima (JP); Takuya Yamazaki, Hiroshima (JP); Kenichi Hatakeyama, Hiroshima (JP); Shinichiro Kurusu, Hiroshima (JP); Akihiro Nakashima, Hiroshima (JP); Toshiharu Nakashima, Hiroshima (JP)

(73) Assignees: MAZDA MOTOR CORPORATION, Hiroshima (JP); IMANISHI MANUFACTURING CO., LTD., Hiroshima (JP); SEKISOU KANAGATA CO., LTD., Hiroshima (JP); KEYLEX CORPORATION, Hiroshima (JP)

( * ) Notice: Subject to any disclaimer, the term of this patent is extended or adjusted under 35 U.S.C. 154(b) by 198 days.

(21) Appl. No.: 13/810,623

(22) PCT Filed: Jun. 21, 2011

(86) PCT No.: PCT/JP2011/003537

§ 371 (c)(1),
(2), (4) Date: Jan. 16, 2013

(87) PCT Pub. No.: WO2012/011224

PCT Pub. Date: Jan. 26, 2012

(65) Prior Publication Data

US 2013/0111966 A1 May 9, 2013

(30) Foreign Application Priority Data

Jul. 21, 2010 (JP) ..... 2010-163717

(51) Int. Cl.
*B21D 22/02* (2006.01)

(52) U.S. Cl.
CPC ..... *B21D 22/022* (2013.01); *B21D 22/02* (2013.01)

(58) Field of Classification Search
CPC .... B21D 22/02; B21D 22/022; B21D 24/005; B21D 24/16
USPC ..... 72/342.2, 342.5, 348, 353.2, 354.2, 72/356, 357, 360, 361, 384, 405.01
See application file for complete search history.

(56) References Cited

U.S. PATENT DOCUMENTS

2004/0163439 A1 8/2004 Arns et al.
2004/0250585 A1 12/2004 Bennett et al.

(Continued)

FOREIGN PATENT DOCUMENTS

CN 101104184 A 1/2008
DE 10307184 B3 4/2004

(Continued)

OTHER PUBLICATIONS

International Searching Authority, International Search Report and Written Opinion for International Application No. PCT/JP2011/003537, mailed Aug. 2, 2011, 10 pages, Japanese Patent Office, Japan.

*Primary Examiner* — Debra Sullivan
(74) *Attorney, Agent, or Firm* — Alston & Bird LLP

(57) ABSTRACT

Consumed energy is minimized to reduce running cost. Final formed products of uniform quality are successively obtained. High productivity is provided. A primary forming step of obtaining a primary formed product by plastically working a heated steel sheet with a primary forming die set for a predetermined time period, a secondary forming step of machining the primary formed product with the secondary forming die set for a predetermined time period to obtain a secondary formed product, and a hardening step of allowing a cooling die set placed in a hydraulic press controlled by a servomotor to hold the secondary formed product under pressure for a longer time period than the time period of each of the primary and secondary forming steps to obtain a hardened final formed product are successively performed in sequence. The hardening step is performed independently without coordinating with the primary and secondary forming steps.

5 Claims, 14 Drawing Sheets

(56) References Cited

U.S. PATENT DOCUMENTS

| | | | | |
|---|---|---|---|---|
| 2008/0134909 | A1 | 6/2008 | Kohno | |
| 2008/0173057 | A1* | 7/2008 | Kruger et al. | 72/342.7 |
| 2010/0307216 | A1* | 12/2010 | De Souza et al. | 72/342.8 |

FOREIGN PATENT DOCUMENTS

| | | | |
|---|---|---|---|
| DE | 602004013264 | T2 | 5/2009 |
| JP | 4-028500 | A | 1/1992 |
| JP | 7-037484 | U | 7/1995 |
| JP | 2000/254799 | A | 9/2000 |
| JP | 2003-145224 | A | 5/2003 |
| JP | 2005-059010 | A | 3/2005 |
| JP | 2005/248253 | A | 9/2005 |
| JP | 2005-262235 | A | 9/2005 |
| JP | 2006/192458 | A | 7/2006 |
| JP | 2007/136533 | A | 6/2007 |
| JP | 2007/136534 | A | 6/2007 |
| JP | 2008-264853 | A | 11/2008 |
| JP | 2009-072801 | A | 4/2009 |

* cited by examiner

METHOD FOR FORMING STEEL SHEET BY HOT PRESSING

CROSS REFERENCE TO RELATED APPLICATIONS

This application is a national stage application, filed under 35 U.S.C. §371, of International Application No. PCT/JP2011/003537, filed Jun. 21, 2011, which claims priority to Japanese Application No. 2010-163717, filed Jul. 21, 2010, both of which are hereby incorporated by reference in their entirety.

BACKGROUND

1. Technical Field

The present invention relates to methods for forming a steel sheet by hot pressing to provide a final formed product hardened by plastically working, machining, and cooling a heated steel sheet in sequence.

2. Description of Related Art

In recent years, in the motor vehicle industry, there is a need for lightweight vehicle body structures providing a high level of safety, and in order to satisfy the need, attention has been given to a method for forming a steel sheet by hot pressing to obtain a strong vehicle body structure without increasing the sheet thickness. For example, in a method for forming a steel sheet by hot pressing according to Japanese Patent Publication No. 2005-248253 (paragraph 0022, FIG. 2), a final formed product is obtained from a steel sheet through a plurality of steps by using one die set. Specifically, a primary formed product is obtained by plastic working in which a steel sheet heated to high temperatures is pressed from above and below so as to be plastically deformed along pressing surfaces of a die set; a secondary formed product is then obtained by machining, e.g., by piercing the primary formed product; and then, the secondary formed product is cooled with the die set held at a bottom dead center position so as to be hardened, thereby obtaining a strong final formed product.

However, in the hot pressing of Japanese Patent Publication No. 2005-248253 (paragraph 0022, FIG. 2), plastic working, machining, and cooling are sequentially performed by using one die set, and thus, it takes considerable time to obtain one final formed product.

To address the problem, a method using a transfer press to increase productivity is contemplated. Specifically, a primary forming die set for primary forming in which plastic working is performed, a secondary forming die set for secondary forming in which machining is performed, a cooling die set for cooling in which cooling is performed are sequentially arranged in the transfer press so as to be synchronously operated. Steel sheets, primary formed products, and secondary formed products are sequentially fed to these die sets, thereby successively obtaining final formed products to increase productivity.

The transfer press is generally comprised of a mechanical press with high productivity. The mechanical press drives a flywheel with a motor, and the driving force of the flywheel is converted to linear motion by a crank mechanism. A clutch, a brake, etc., are provided on a power transmission path through which the driving force is transmitted, and the engagement of the clutch allows the driving force of the flywheel to be transmitted to the crank mechanism to move the die sets placed in the press up and down, and with application of the brake, the vertical movement of the die sets is stopped.

Incidentally, a cooling (hardening) step for a secondary formed product in hot pressing takes a longer time than the other two steps. Therefore, when a cooling die set is held at a bottom dead center position for a predetermined time period to cool a secondary formed product with a transfer press, the other die sets for primary forming and secondary forming are also held at corresponding bottom dead center positions for the same time period, and thus, primary and secondary formed products are held in contact with the corresponding die sets for a longer time period than necessary, thereby releasing the heat of each of the primary and secondary formed products to the corresponding die set. This release causes the temperature of the secondary formed product immediately before being carried into the cooling die set to be lower than the hardening start temperature at which hardening starts and which is required for hardening.

In order to avoid this, in a method for forming a steel sheet by hot pressing according to Japanese Patent Publication No. 2007-136533 (paragraph 0028, FIG. 1), primary and secondary formed products are heated or kept warm while being held in corresponding die sets to prevent the temperature of each of the primary and secondary formed products from being lower than the hardening start temperature.

However, in Japanese Patent Publication No. 2007-136533 (paragraph 0028, FIG. 1), a large amount of energy is consumed to manage the temperature of each of the primary and secondary formed products, and thus, the running cost, such as the electricity cost, increases.

With the use of a mechanical press for a cooling step in a transfer press, even when a brake is applied to stop a corresponding die set at a bottom dead center position, shock caused by the contact between upper and lower dies of the die set causes the stop location at which the die set stops to deviate slightly from the normal stop location corresponding to the bottom dead center position, and thus, when secondary formed products are sequentially held in the cooling die set under pressure, the conditions of contact between the secondary formed products and the cooling die set vary, and thus, the quality of final formed products may vary in continuous production.

Furthermore, while improvement in productivity is expected by simply increasing the speed of the vertical movement of the cooling die set, an increase in the operating speed of a press of the mechanical press causes the brake for stopping the vertical movement of the cooling die set to be less effective, and thus, the conditions of the contact between the secondary formed products held under pressure and the cooling die set may further vary.

It is therefore an object of the present invention to provide a method for forming a steel sheet by hot pressing which method reduces the energy consumption to a minimum to reduce the running cost, can successively provide final formed products of uniform quality, and furthermore offers high productivity.

BRIEF SUMMARY

In order to achieve the above object, a feature of the present invention is that a hydraulic press controlled by a servomotor operates a cooling die set independently without coordinating with primary and secondary forming die sets.

Specifically, according to a first aspect of the invention, a primary forming step of obtaining a primary formed product by performing plastic working in which a heated steel sheet is pressed by upper and lower dies of a primary forming die set for a predetermined time period so as to be plastically deformed along a pressing surface of each of the upper and lower dies; a secondary forming step of carrying the primary formed product into a secondary forming die set, and machining the primary formed product with upper and lower dies of the secondary forming die set for a predetermined time period to obtain a secondary formed product; and a hardening step of carrying the secondary formed product into a cooling die set placed in a hydraulic press controlled by a servomotor, and allowing upper and lower dies of the cooling die set to hold the secondary formed product under pressure for a longer time period than the time period of each of the primary and secondary forming steps to obtain a hardened final formed product are successively performed in sequence, the hardening step is configured so as to be performed independently without coordinating with the primary and secondary forming steps, and between a start of hardening and an end of the hardening in the hardening step, the primary and secondary forming steps are both completed, the primary and secondary forming die sets are opened, the primary formed product plastically worked in the primary forming step and the secondary formed product machined in the secondary forming step are each separated from a pressing surface of at least one of the upper or lower die of a corresponding one of the die sets.

According to a second aspect of the invention, in the first aspect of the invention, the primary and secondary forming die sets may operate in synchronization with each other by using corresponding mechanical presses.

According to a third aspect of the invention, in the second aspect of the invention, the cooling die set including two cooling die sets may be prepared, while the secondary formed product is cooled with one of the cooling die sets, a secondary formed product subsequently machined with the secondary forming die set may be carried into the other cooling die set so as to be cooled, and while the secondary formed product is cooled with the other cooling die set, a hardened final formed product may be removed from the one of the cooling die sets.

According to a fourth aspect of the invention, in any one of the first through third aspects of the invention, a temperature of at least one of the primary or secondary forming die set may be adjusted by a temperature adjuster such that when the temperature of the at least one of the primary or secondary forming die set is lower than a temperature at which hardening of the secondary formed product starts, the temperature of the at least one of the primary or secondary forming die set is increased, and when the temperature of the at least one of the primary or secondary forming die set is higher than the temperature at which hardening of the secondary formed product starts, the temperature of the at least one of the primary or secondary forming die set is decreased.

According to a fifth aspect of the invention, in any one of the first through fourth aspects of the invention, between a start of hardening and an end of the hardening in the hardening step, at least one of the primary or secondary formed product may be separated from both a pressing surface of the corresponding upper die and a pressing surface of the corresponding lower die by a separator.

According to the first aspect of the invention, when the secondary formed product is held under pressure by the cooling die set, the primary formed product formed with the primary forming die set and the secondary formed product formed with the secondary forming die set are each prevented from being in contact with the pressing surface of at least one of the upper or lower die of the corresponding die set. This can avoid a situation where heat of each of the primary and secondary formed products is released to at least one of the upper or lower die of the corresponding die set to cause the temperature of the secondary formed product to be lower than the temperature at which hardening starts, thereby reducing the energy consumed by, e.g., such a heating process for keeping the temperature of each of the primary and secondary formed products high as in Japanese Patent Publication No. 2007-136533 (paragraph 0028, FIG. 1) to a minimum to reduce the running cost. Since the cooling die set is moved up and down with the hydraulic press controlled by the servomotor, the cooling die set can be stopped at a normal location even with an increase in the speed of the vertical movement of the cooling die set. Therefore, the cooling die set can be stopped at the bottom dead center position without variations to shorten the time between the carrying of the secondary formed product into the cooling die set and the removal of the final formed product to thereby increase productivity, and secondary formed products successively carried into the cooling die set press against the cooling die set without variations to provide final formed products of uniform quality.

According to the second aspect of the invention, since the mechanical presses which have been conventionally often used in plastic working and machining are used, primary and secondary formed products can be obtained without problems, and since the mechanical presses which do not require a complicated control circuit unlike the hydraulic press are used, the cost of an entire production line can be reduced.

According to the third aspect of the invention, while the secondary formed product is cooled with one of the cooling die sets, subsequent primary and secondary formed products are obtained with the primary and secondary forming die sets, respectively, thereby doubling production through the entire production line without increasing the number of primary forming die sets and the number of secondary forming die sets to achieve a compact production line providing high productivity.

According to the fourth aspect of the invention, when the temperature of each of the primary and secondary forming die sets is low at a production start time at which the outside air temperature is low, or when the temperature of each of the primary and secondary forming die sets is increased due to the frictional heat generated in continuous production, the temperature of each of the primary and secondary forming die sets can be adjusted to the temperature at which hardening starts, thereby reducing variations among the temperatures of secondary formed products carried into the cooling die set. This enables the hardening of the final formed products in the cooling die set without variations, and can provide final formed products of uniform quality.

According to the fifth aspect of the invention, when the secondary formed product is held under pressure by the cooling die set, the primary formed product obtained with the primary forming die set and the secondary formed product obtained with the secondary forming die set are each never in contact with both the pressing surface of the upper die of the corresponding die set and the pressing surface of the lower die thereof. This ensures the prevention of the heat release from both of the pressing surface of the upper die and the pressing surface of the lower die, and avoids a situation where the temperature of the secondary formed product becomes lower than the temperature at which hardening starts, thereby further reducing the energy consumed by, e.g., such a heating process for keeping the temperature of each of the primary and secondary formed products high as in Japanese Patent Publication No. 2007-136533 (paragraph 0028, FIG. 1) to reduce the running cost.

DETAILED DESCRIPTION

Embodiments of the present invention will be described hereinafter in detail with reference to the drawings. The following preferred embodiments are merely examples in nature.

Figure 1:
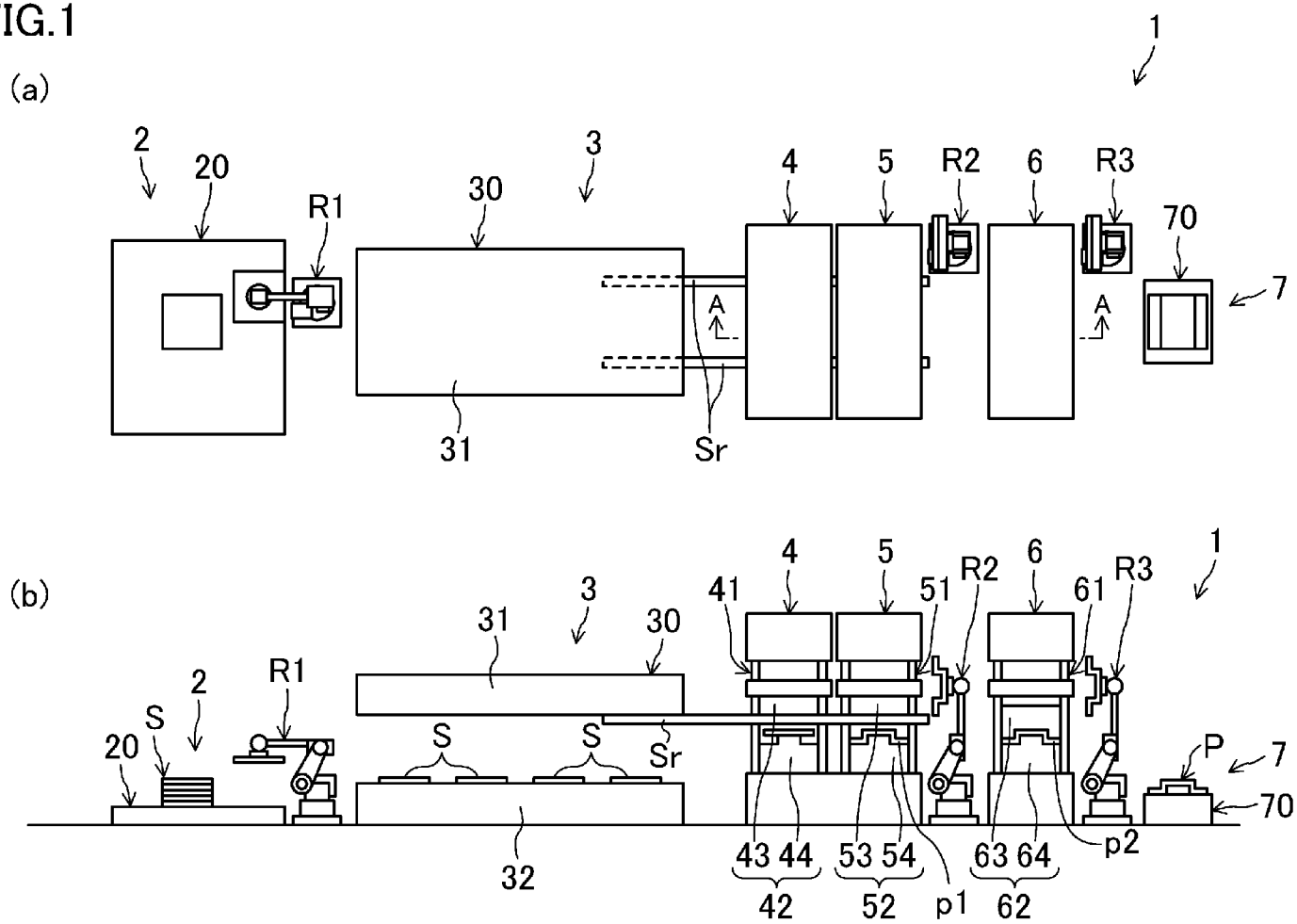
FIGS. 1(*a*) and 1(*b*) illustrate the layout of a production line to which a forming method according to a first embodiment of the present invention is applied, in which FIG. 1(*a*) is a plan view of the production line, and FIG. 1(*b*) is a side view thereof.
Figure 2:
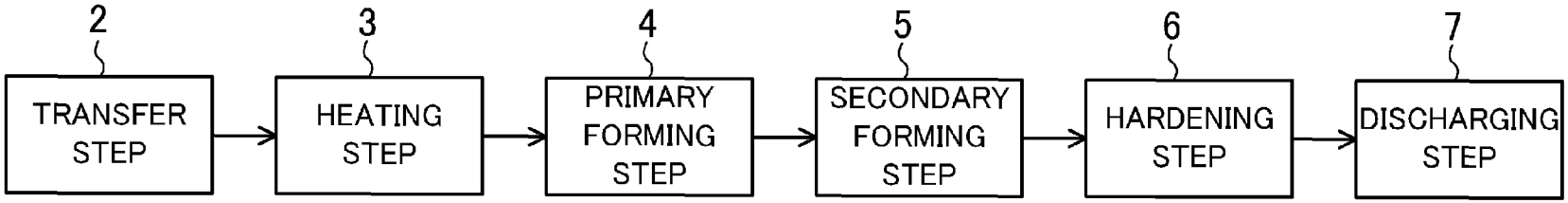
FIG. 2 is a block diagram of the production line to which the forming method according to the first embodiment of the present invention is applied.

FIGS. 1(*a*) and 1(*b*) illustrate a production line 1 according to a first embodiment of the present invention. The production line 1 is configured to form steel sheets S by hot pressing, and as illustrated in FIG. 2, a section of the production line 1 implementing a carrying step 2 in which steel sheets S before being formed are stored, a section thereof implementing a heating step 3 in which steel sheets S carried from the section implementing the carrying step 2 are heated, a section thereof implementing a primary forming step 4 in which plastic working of each of the steel sheets S heated in the heating step 3 is performed for a predetermined time period, a section thereof implementing a secondary forming step 5 in which a primary formed product p1 formed in the primary forming step 4 is machined, e.g., pierced, for a predetermined time period, a section thereof implementing a hardening step 6 in which a secondary formed product p2 formed by being machined in the secondary forming step 5 is held under pressure so as to be hardened, and a section thereof implementing a discharging step 7 in which a final formed product P hardened in the hardening step 6 is removed from the section implementing the hardening step 6 and stored are arranged on a substantially straight line sequentially from the upstream side of the production line 1. The above-described term "plastic working" denotes processes, such as draw forming, crash forming, and bend forming. In the secondary forming step 5, when machining, such as piercing, is performed, bending, etc., may be performed to some extent.

The section implementing the carrying step 2 includes a first pallet 20 on which a plurality of steel sheets S cut into an appropriate shape in an unshown cutting step are placed one on another. A first robot R1 which is an industrial robot is disposed between the section implementing the carrying step 2 and the section implementing the heating step 3, and the first robot R1 sequentially carries the steel sheets S stacked on the first pallet 20 into the section implementing the heating step 3.

The section implementing the heating step 3 includes a heating furnace 30 extending from the upstream side of the production line 1 to the downstream side thereof, and heating the steel sheets S. The heating furnace 30 includes a lower furnace body 32 which is a lower portion of the heating furnace 30, and an upper furnace body 31 which is an upper portion of the heating furnace 30 opposed to the lower furnace body 32, and although not shown, the lower furnace body 32 includes a plurality of rollers rotationally driven by a motor, and a heater configured to increase the temperature of atmospheric gas between the upper furnace body 31 and the lower furnace body 32. The steel sheets S carried into the upstream side of the heating furnace 30 by the first robot R1 are carried to the downstream side of the production line 1 through the plurality of rollers in the heating furnace 30, and during the time period during which the steel sheets S are carried to the downstream side, the temperatures of the steel sheets S are increased to temperatures of about 800-1000° C. with the atmospheric gas the temperature of which is increased by the heater.

Two transfer rails Sr are laid between the section implementing the heating step 3 and the section implementing the secondary forming step 5 to pass through the section implementing the primary forming step 4, and two unshown automatic conveyors are movably placed on the transfer rails Sr. The automatic conveyors are used to carry the steel sheets S heated in the heating furnace 30 into the section implementing the primary forming step 4, and simultaneously carry the primary formed product p1 plastically worked in the primary forming step 4 into the section implementing the secondary forming step 5.

The section implementing the primary forming step 4 includes a mechanical press 41, and a primary forming die set 42 configured to perform plastic working in which a steel sheet S is pressed from above and below so as to be plastically deformed is placed in the mechanical press 41. As illustrated in FIGS. 3-6, the mechanical press 41 is configured to move an upper die 43 of the primary forming die set 42 upward from a lower die 44 thereof and downward to the lower die 44.

The lower die 44 has a lower pressing surface 44*a* having a generally protruding portion when viewed in cross section, and the upper die 43 has an upper pressing surface 43*a* having a generally depressed portion when viewed in cross section, and corresponding to the lower pressing surface 44*a* of the lower die 44. When one of the heated steel sheets S is placed on the lower pressing surface 44*a* of the lower die 44, and the upper die 43 is moved down to a bottom dead center position, the steel sheet S is plastically worked to obtain a primary formed product p1 having a cross section forming a generally hat-like shape.

As illustrated in FIGS. 3-6, a pipe 46 is disposed inside the lower die 44 of the primary forming die set 42, and a driver 47 configured to circulate a heating medium, such as hot water, between the lower die 44 and a storage tank outside the drawings is connected to the pipe 46. A temperature sensor 48 is connected to the primary forming die set 42. A temperature adjuster 45 of the present invention includes the pipe 46, the driver 47, and the temperature sensor 48, the temperature sensor 48 detects the temperature of the primary forming die set 42, and the temperature of the heating medium circulating through the pipe 46 is adjusted such that when the temperature of the primary forming die set 42 is lower than the temperature at which a secondary formed product p2 is hardened (about 650° C.), the temperature of the primary forming die set 42 is increased, and when the temperature of the primary forming die set 42 is higher than the temperature at which the secondary formed product p2 is hardened, the temperature of the primary forming die set 42 is decreased.

The section implementing the secondary forming step 5 includes a mechanical press 51, and a secondary forming die set 52 configured to pierce the primary formed product p1 is placed in the mechanical press 51. As illustrated in FIGS. 3-6, the drive source of the mechanical press 51 is in synchronization with the drive source of the mechanical press 41, and the primary and secondary forming die sets 42 and 52 operate in synchronization with each other.

The lower die 54 has a lower pressing surface 54*a* having a generally protruding portion when viewed in cross section, and corresponding to the shape of the back surface of the primary formed product p1, and a piercing hole 54*b* for piercing is formed in the top part of the lower pressing surface 54*a*. The upper die 53 has an upper pressing surface 53*a* having a generally depressed portion when viewed in cross section, and corresponding to the shape of the front surface of the primary formed product p1, and the upper pressing surface 53*a* includes a piercing protrusion 53*b* corresponding to the piercing hole 54*b*. When the primary formed product p1 is placed on the lower pressing surface 54*a* of the lower die 54 with the back surface of the primary formed product p1 facing toward the lower die 54, the back surface of the primary formed product p1 is along the lower pressing surface 54*a*. When, in this situation, the upper die 53 is moved down to the bottom dead center position, the primary formed product p1 is pierced with the piercing hole 54*b* and the piercing protrusion 53*b* to obtain a secondary formed product p2.

As illustrated in FIGS. 3-6, a pipe 56 is disposed inside the lower die 54 of the secondary forming die set 52, and a driver 57 configured to circulate a heating medium, such as hot water, between the lower die 54 and a storage tank outside the drawings is connected to the pipe 56. A temperature sensor 58 is connected to the secondary forming die set 52. The temperature adjuster 55 of the present invention includes the pipe 56, the driver 57, and the temperature sensor 58, the temperature sensor 58 detects the temperature of the secondary forming die set 52, and the temperature of the heating medium circulating through the pipe 56 is adjusted such that when the temperature of the secondary forming die set 52 is lower than the temperature at which the secondary formed product p2 is hardened, the temperature of the secondary forming die set 52 is increased, and when the temperature of the secondary forming die set 52 is higher than the temperature at which the secondary formed product p2 is hardened, the temperature of the secondary forming die set 52 is decreased.

A second robot R2 which is an industrial robot is disposed between the section implementing the secondary forming step 5 and the section implementing the hardening step 6, and the second robot R2 sequentially carries secondary formed products p2 formed in the secondary forming step 5 into the section implementing the hardening step 6.

The section implementing the hardening step 6 includes a hydraulic press 61, and a cooling die set 62 for cooling is placed in the hydraulic press 61. The hardening step 6 is configured so as to be performed independently without coordinating with the primary and secondary forming steps 4 and 5, the hydraulic press 61 operates under the control of a servomotor, and an upper die 63 of the cooling die set 62 is moved upward from a lower die 64 thereof and downward to the lower die 64.

The lower die 64 has a lower pressing surface 64*a* having a generally protruding portion when viewed in cross section, and corresponding to the shape of the back surface of the secondary formed product p2, and when the secondary formed product p2 is placed on the lower pressing surface 64*a* of the lower die 64 with the back surface of the secondary formed product p2 facing toward the lower die 64, the back surface of the secondary formed product p2 is along the lower pressing surface 64*a*. The upper die 63 has an upper pressing surface 63*a* having a generally depressed portion when viewed in cross section, and corresponding to the shape of the front surface of the secondary formed product p2. The size of a gap G formed between the upper pressing surface 63*a* and the lower pressing surface 64*a* with the upper die 63 of the cooling die set 62 moved down to the bottom dead center position is set at a size slightly smaller than the thickness of the secondary formed product p2. Therefore, when the upper die 63 is moved down with the secondary formed product p2 placed on the lower die 64, the cooling die set 62 presses against the front and back surfaces of the secondary formed product p2.

As illustrated in FIGS. 3-6, a pipe 66 is disposed inside the upper and lower dies 63 and 64, and a driver 67 configured to circulate cold water between each of the upper and lower dies 63 and 64 and a storage tank outside the drawings is connected to the pipe 66. A temperature sensor 68 is connected to the cooling die set 62. A cooler 65 of the present invention includes the pipe 66, the driver 67, and the temperature sensor 68, the temperature sensor 68 detects the temperature of the cooling die set 62, and the temperature of the cold water circulating through the pipe 66 is adjusted such that when the temperature of the cold water is higher than the set temperature of the cold water for hardening, the temperature of the cold water is decreased.

A third robot R3 which is an industrial robot is disposed between the section implementing the hardening step 6 and the section implementing the discharging step 7, and final formed products P formed in the hardening step 6 are sequentially removed from the section implementing the hardening step 6 and carried into the section implementing the discharging step 7 by the third robot R3.

The section implementing the discharging step 7 includes a second pallet 70 on which a final formed product P formed in the hardening step 6 is placed, and a plurality of final formed products P sequentially formed in the hardening step 6 can be stacked on the second pallet 70.

Next, a method for manufacturing a final formed product P from a steel sheet S by hot pressing along the production line 1 will be described.

Figure 3:
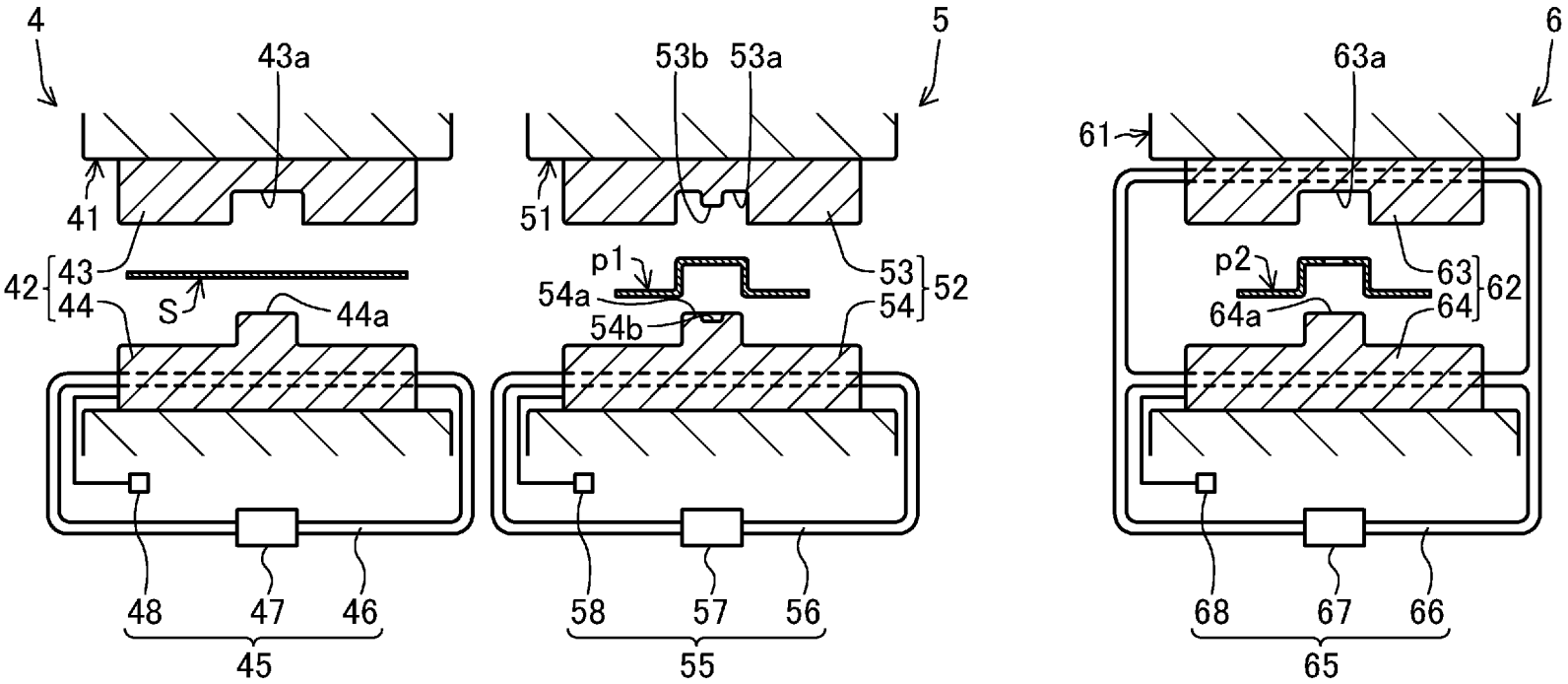
FIG. 3 is a cross-sectional view taken along the line A-A in FIG. 1(*a*), and illustrates a situation where a steel sheet, a primary formed product, and a secondary formed product are carried into a primary forming die set, a secondary forming die set, and a cooling die set, respectively, each having an upper die which has moved up.

FIG. 3 illustrates a situation where a steel sheet S heated in a heating furnace 30, a primary formed product p1 formed with a primary forming die set 42, and a secondary formed product p2 formed with a secondary forming die set 52 are carried into the primary forming die set 42, the secondary forming die set 52, and a cooling die set 62, respectively.

Figure 4:
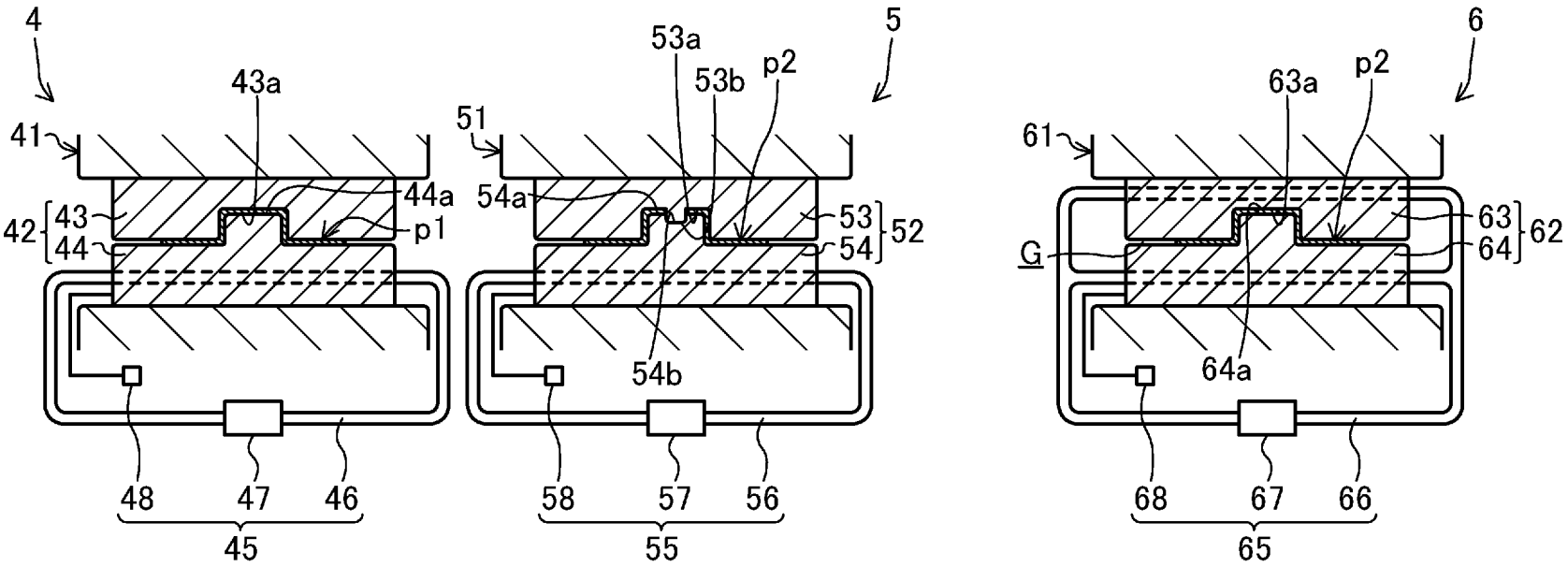
FIG. 4 illustrates a situation where the upper dies of the primary forming die set, the secondary forming die set, and the cooling die set are moved downward from their positions in FIG. 3 to plastically work the steel sheet with the primary forming die set, machine the primary formed product with the secondary forming die set, and cool (harden) the secondary formed product with the cooling die set.

First, as illustrated in FIG. 4, an upper die 43 of the primary forming die set 42 and an upper die 53 of the secondary forming die set 52 are moved down from their positions illustrated in FIG. 3 in synchronization with each other, and an upper die 63 of the cooling die set 62 also moves down at the same time as the upper dies 43 and 53. A primary formed product p1 is formed from the steel sheet S with the primary forming die set 42, a secondary formed product p2 is formed from the primary formed product p1 with the secondary forming die set 52, and the hardening of the secondary formed product p2 is started with the secondary formed product p2 held under pressure by the cooling die set 62.

Figure 5:
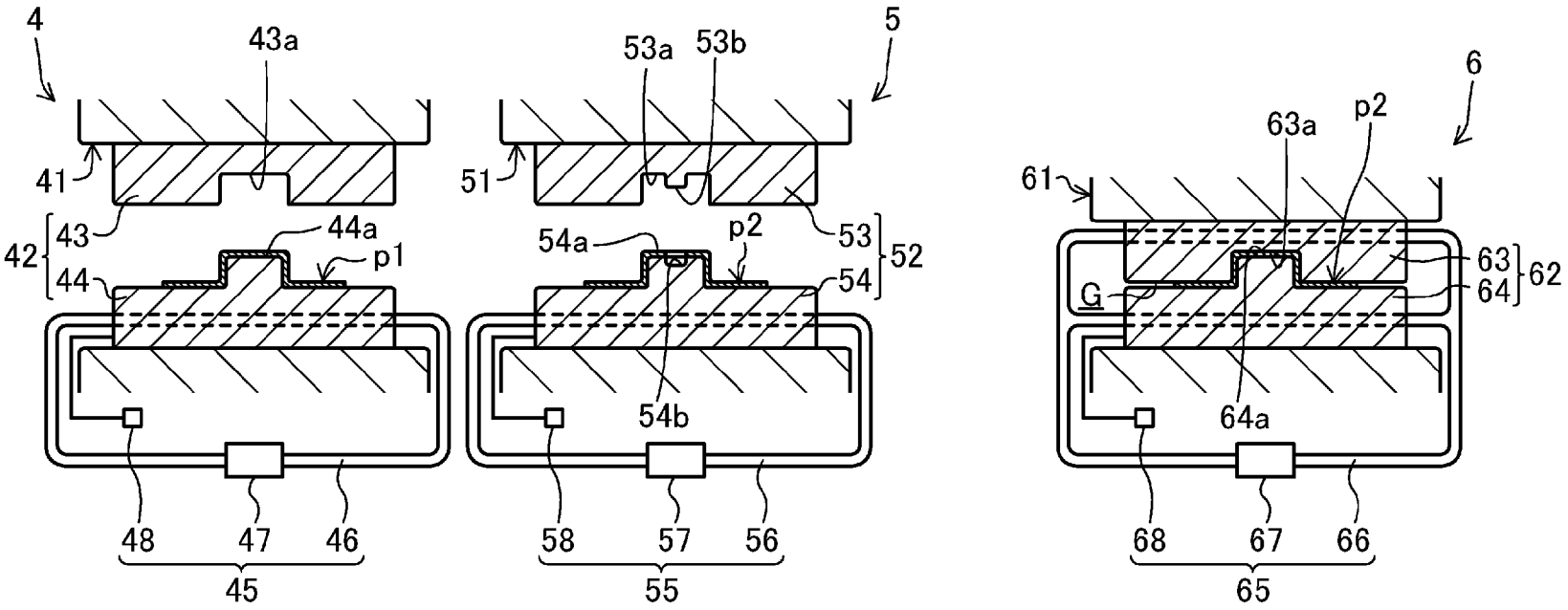
FIG. 5 illustrates a situation where while the upper dies of the primary and secondary forming die sets move upward from their positions in FIG. 4 so that primary and secondary formed products are separated from pressing surfaces of the corresponding die sets, the secondary formed product is cooled (hardened) with the cooling die set.

Next, as illustrated in FIG. 5, while the secondary formed product p2 is hardened with the upper die 63 of the cooling die set 62 moved down, the upper die 43 of the primary forming die set 42 and the upper die 53 of the secondary forming die set 52 move up in synchronization with each other without coordinating with the cooling die set 62; the primary formed product p1 plastically worked in the primary forming step 4 is separated from an upper pressing surface 43*a* of the upper die 43 while being in contact with a lower pressing surface 44*a* of the lower die 44; and the secondary formed product p2 pierced in the secondary forming step 5 is separated from an upper pressing surface 53*a* of the upper die 53 while being in contact with a lower pressing surface 54*a* of the lower die 54. Therefore, when the secondary formed product p2 is held under pressure by the cooling die set 62, the contact between the primary formed product p1 formed with the primary forming die set 42 and the upper pressing surface 43*a* of the upper die 43 can be prevented, and the contact between the secondary formed product p2 formed with the secondary forming die set 52 and the upper pressing surface 53*a* of the upper die 53 can be prevented. This can avoid a situation where the heat of the primary formed product p1 and the heat of the secondary formed product p2 are released to the upper pressing surface 43*a* of the upper die 43 and the upper pressing surface 53*a* of the upper die 53, respectively, to cause the temperature of the secondary formed product p2 to be lower than the temperature at which the secondary formed product p2 is hardened, thereby reducing the energy consumed by, e.g., such a heating process for keeping the temperature of each of the primary and secondary formed products p1 and p2 high as in Japanese Patent Publication No. 2007-136533 (paragraph 0028, FIG. 1) to a minimum to reduce the running cost.

Also when the die sets are configured such that the primary formed product p1 plastically worked in the primary forming step 4 and the secondary formed product p2 pierced in the secondary forming step 5 are in contact with the upper pressing surfaces 43*a* and 53*a* of the upper dies 43 and 53, respectively, and are separated from the lower pressing surfaces 44*a* and 54*a* of the lower dies 44 and 54, respectively, with the die sets opened, advantages similar to the above advantages can be provided.

Figure 6:
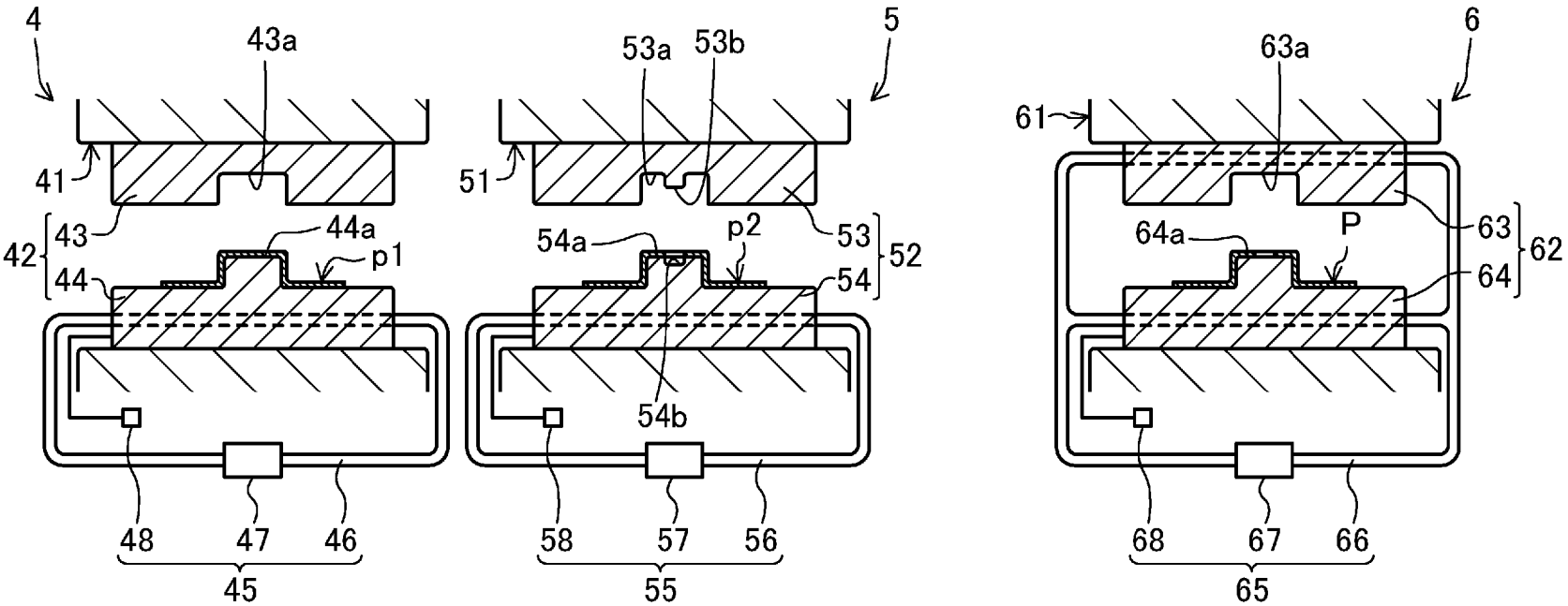
FIG. 6 illustrates a situation where the upper die of the cooling die set moves upward from its position in FIG. 5, and a final formed product is obtained.
Figure 7:
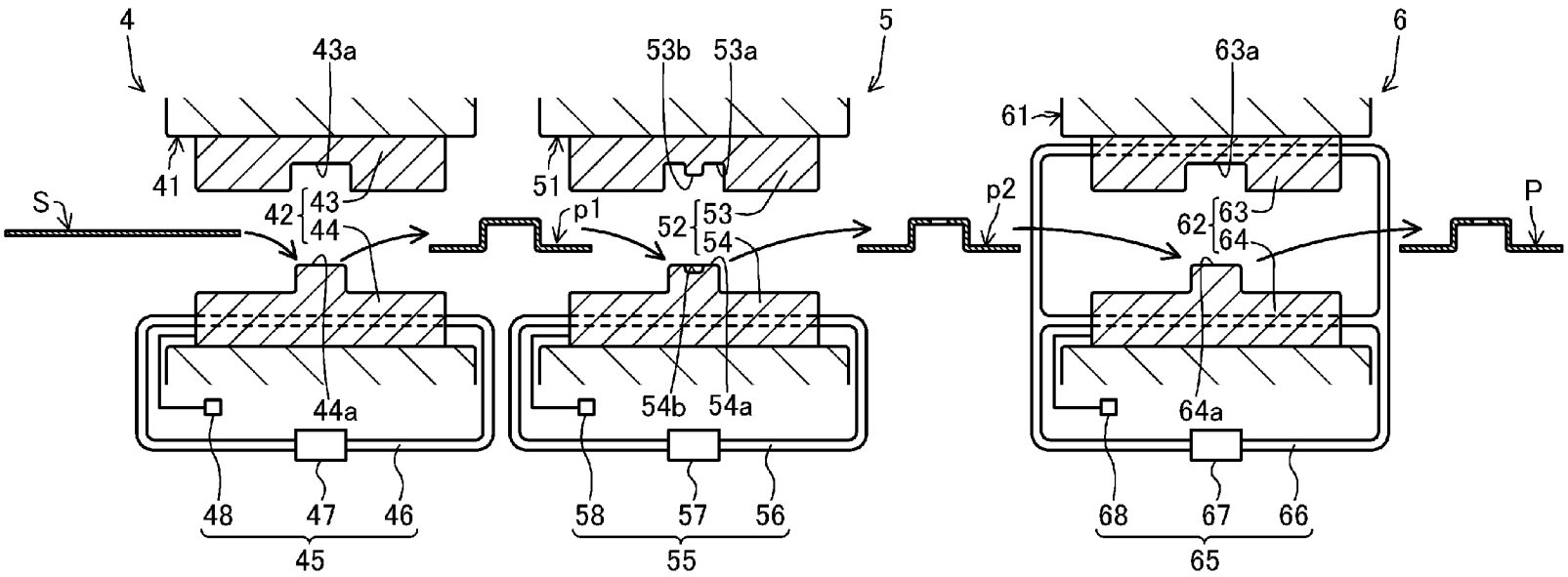
FIG. 7 illustrates a situation where the situation in FIG. 6 is changed so that the final formed product is removed from the cooling die set, the secondary formed product is removed from the secondary forming die set and carried into the cooling die set, the primary formed product is removed from the primary forming die set and carried into the secondary forming die set, and a steel sheet is carried into the primary forming die set.

Next, after a lapse of a predetermined time period from the time when the situation in FIG. 5 starts, hardening is finished in the cooling die set 62 to obtain a final formed product P, and as illustrated in FIG. 6, the upper die 63 of the cooling die set 62 moves up. Subsequently, the final formed product P is removed from the cooling die set 62 by the third robot R3, the secondary formed product p2 is removed from the secondary forming die set 52 and carried into the cooling die set 62 by the second robot R2, the primary formed product p1 is simultaneously removed from the primary forming die set 42 and carried into the secondary forming die set 52 by an automatic conveyor (not shown), and the steel sheet S is then removed from the heating furnace 30 and carried into the primary forming die set 42 by an automatic conveyor (not shown). As such, a primary forming step 4, a secondary forming step 5, and a hardening step 6 are successively performed in sequence, thereby obtaining final formed products P on the production line.

When the final formed products P are to be successively obtained, the temperature adjusters 45 and 55 each adjust the temperature of a heating medium circulating through a corresponding one of the pipes 46 and 56 such that when the temperature of a corresponding one of the primary and secondary forming die sets 42 and 52 is low at a production start time at which the outside air temperature is low, the temperature thereof is increased, and when the temperature of a corresponding one of the primary and secondary forming die sets 42 and 52 is increased due to the frictional heat generated in the continuous production, the temperature thereof is decreased. Therefore, the temperatures of the primary and secondary forming die sets 42 and 52 can be adjusted to the temperature at which hardening is started by the temperature adjusters 45 and 55, thereby reducing variations among the temperatures of secondary formed products p2 carried into the cooling die set 62. This enables the hardening of final formed products P in the cooling die set 62 without variations, and can provide final formed products P of uniform quality.

In view of the above, according to the first embodiment of the present invention, since the cooling die set 62 is moved up and down by the hydraulic press 61 controlled by the servomotor, the cooling die set 62 can be stopped at a normal location even with an increase in the speed of the vertical movement of the cooling die set 62. Therefore, the cooling die set 62 can be stopped at the bottom dead center position without variations to shorten the time between the carrying of the secondary formed product p2 into the cooling die set 62 and the removal of the final formed product P to thereby increase productivity, and secondary formed products p2 successively carried into the cooling die set 62 press against the cooling die set 62 without variations to provide final formed products P of uniform quality.

Furthermore, since the mechanical presses 41 and 51 which have been conventionally often used in plastic working and machining are used, primary formed products p1 and secondary formed products p2 can be obtained without problems, and since the mechanical presses 41 and 51 which do not require a complicated control circuit unlike the hydraulic press 61 are used, the cost of the entire production line 1 can be reduced.

Although, in the first embodiment, a heating medium, such as hot water, is used to heat the primary and secondary forming die sets 42 and 52, the heating medium does not necessarily need to be used, and the die sets may be heated, for example, by electrical heat generation.

Although the mechanical presses 41 and 51 are used in the primary and secondary forming steps 4 and 5, hydraulic presses may be used to obtain primary and secondary formed products p1 and p2.

Although, in the primary and secondary forming steps 4 and 5, the vertical movement of the upper die 43 of the primary forming die set 42 is in synchronization with that of the upper die 53 of the secondary forming die set 52, the vertical movement of the upper die 43 may be prevented from being in synchronization with that of the upper die 53.

Although, in the heating furnace 30 of this embodiment, the steel sheets S are heated by increasing the temperature of the atmospheric gas to high temperatures, a heating process is not limited to the above process, and a heating process using, e.g., induction heating may be used.

Although automatic conveyors (not shown) are used to carry the primary formed product p1 from the section implementing the primary forming step 4 into the section implementing the secondary forming step 5 and carry the steel sheet S from the section implementing the heating step 3 into the section implementing the primary forming step 4, industrial robots may be used to carry such products into the corresponding sections.

Although, in the first embodiment, the pipes 46 and 56 are disposed only in the lower dies 44 and 54 of the primary and secondary forming die sets 42 and 52, respectively, to adjust the temperatures of the die sets, the pipes 46 and 56 may be disposed in the upper dies 43 and 53, respectively, to adjust the temperatures of the die sets.

Although the primary and secondary forming die sets 42 and 52 include the temperature adjusters 45 and 55, respectively, the temperature of at least one of the primary and secondary forming die sets 42 and 52 may be adjusted.

Figure 8:
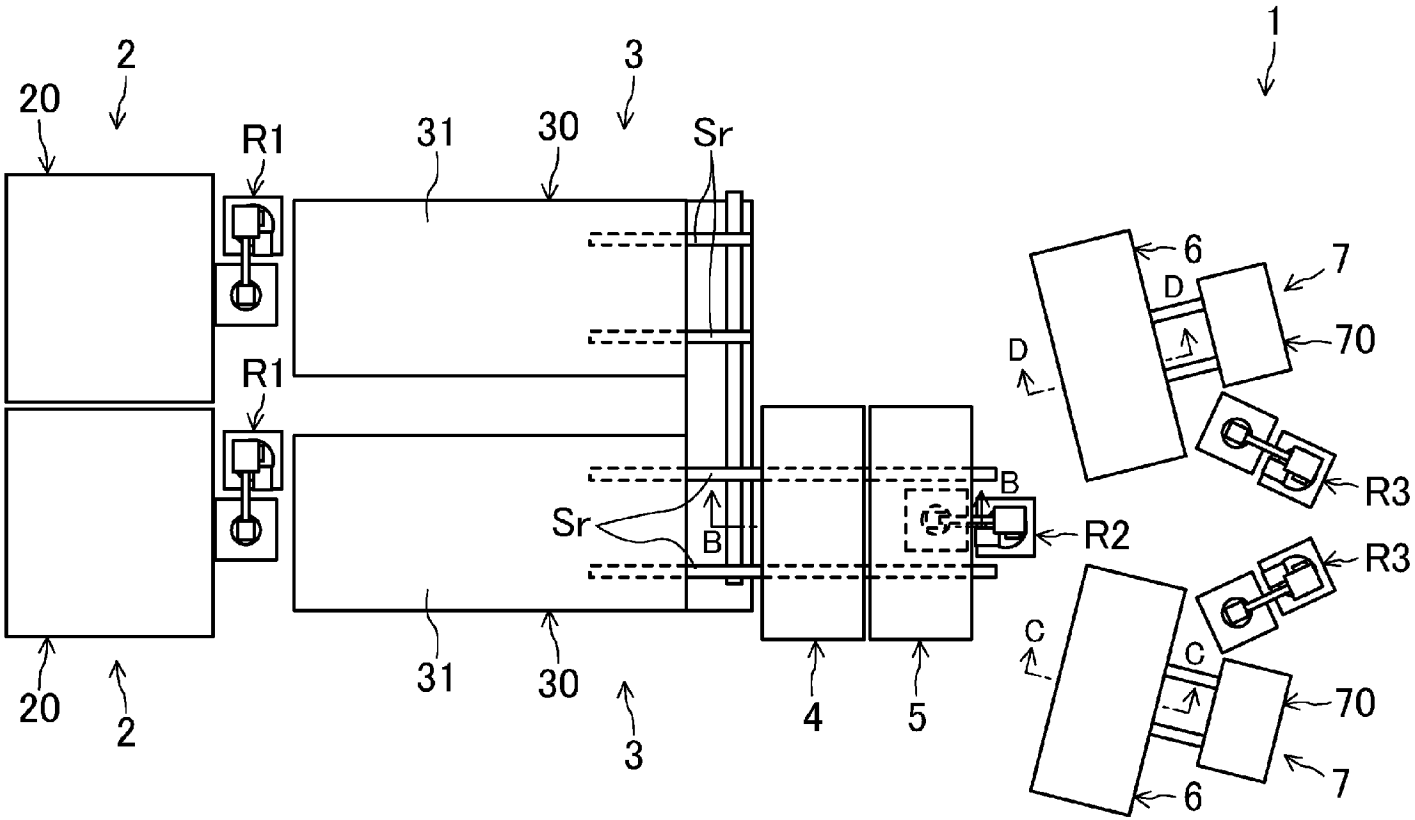
FIG. 8 is a diagram corresponding to FIG. 1(*a*) according to a second embodiment of the present invention.

FIG. 8 illustrates a production line 1 according to a second embodiment of the present invention. Unlike the first embodiment, the production line 1 of the second embodiment includes two sections which each implement a carrying step 2 and are arranged in parallel, two sections which each implement a heating step 3 and are arranged in parallel, two sections which each implement a hardening step 6 and are arranged in parallel, and two sections which each implement a discharging step 7 and are arranged in parallel, and the other elements are identical with those of the first embodiment; thus, the difference between the first and second embodiments will be described in detail.

A first robot R1 is disposed between each of the sections implementing the carrying step 2 and one of the sections implementing the heating step 3, which is placed in parallel with the section implementing the carrying step 2, and a third robot R3 is disposed between each of the sections implementing the hardening step 6 and one of the sections implementing the discharging step 7, which is placed in parallel with the section implementing the hardening step 6. Each of the two sections implementing the heating section 3 is connected to the section implementing the primary forming step 4 through transfer rails Sr extending from the section implementing the heating step 3 to the section implementing the primary forming step 4, thereby sequentially carrying steel sheets S heated in the heating step 3 into the section implementing the primary forming step 4.

Next, a method for manufacturing a final formed product P from a steel sheet S by hot pressing along the production line 1 of the second embodiment will be described.

Figure 9:
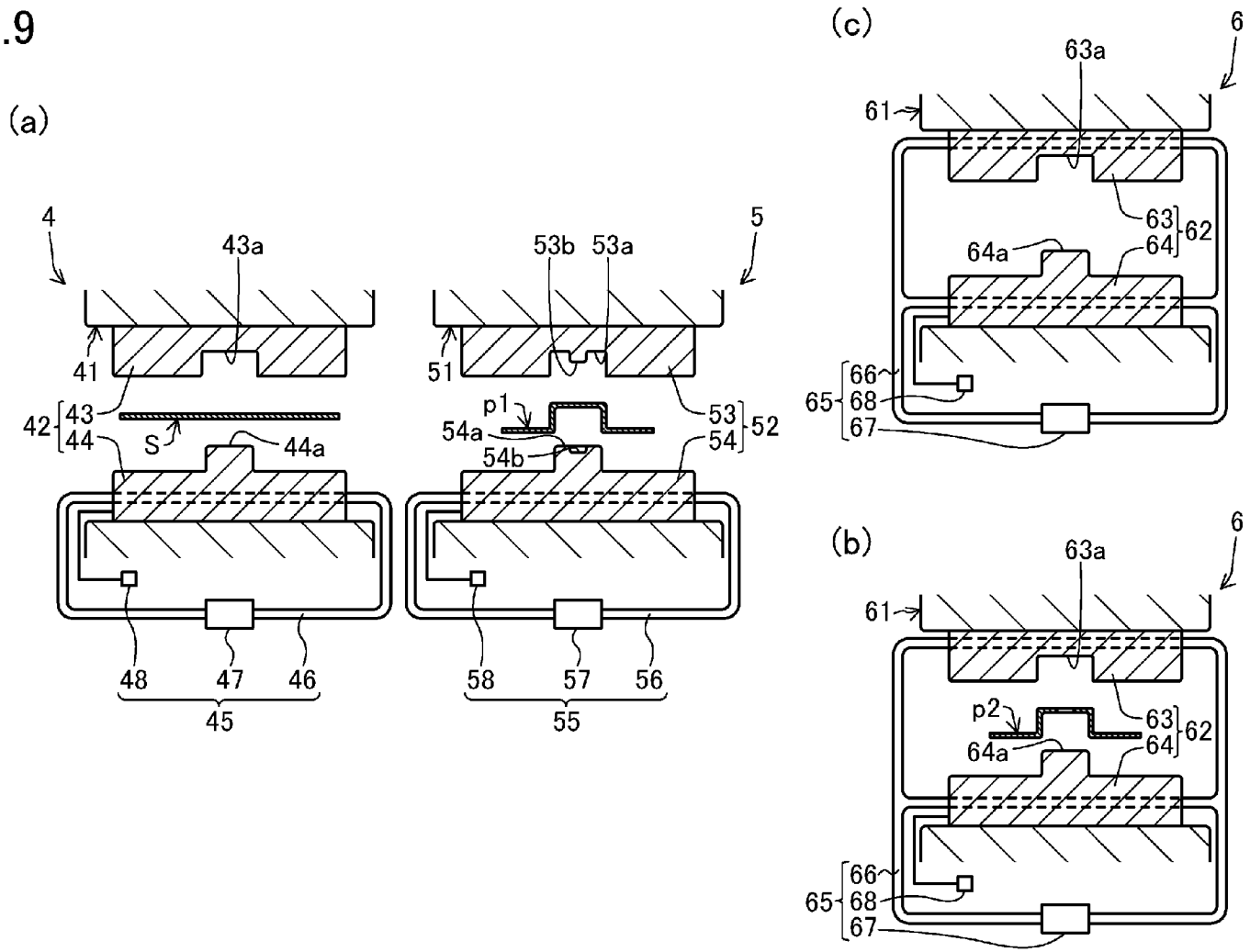
FIG. 9(*a*) is a cross-sectional view taken along the line B-B in FIG. 8, FIG. 9(*b*) is a cross-sectional view taken along the line C-C in FIG. 8, FIG. 9(*c*) is a cross-sectional view taken along the line D-D in FIG. 8, and FIGS. 9(*a*)-9(*c*) illustrate a situation where a steel sheet, a primary formed product, and a secondary formed product are carried into a primary forming die set, a secondary forming die set, and one of cooling die sets, respectively, each having an upper die which has moved up.

FIGS. 9(*a*)-9(*c*) illustrate a situation where a steel sheet S heated in a heating furnace 30, a primary formed product p1 formed with a primary forming die set 42, and a secondary formed product p2 formed with a secondary forming die set 52 are carried into the primary forming die set 42, the secondary forming die set 52, and one of two cooling die sets 62, respectively.

Figure 10:
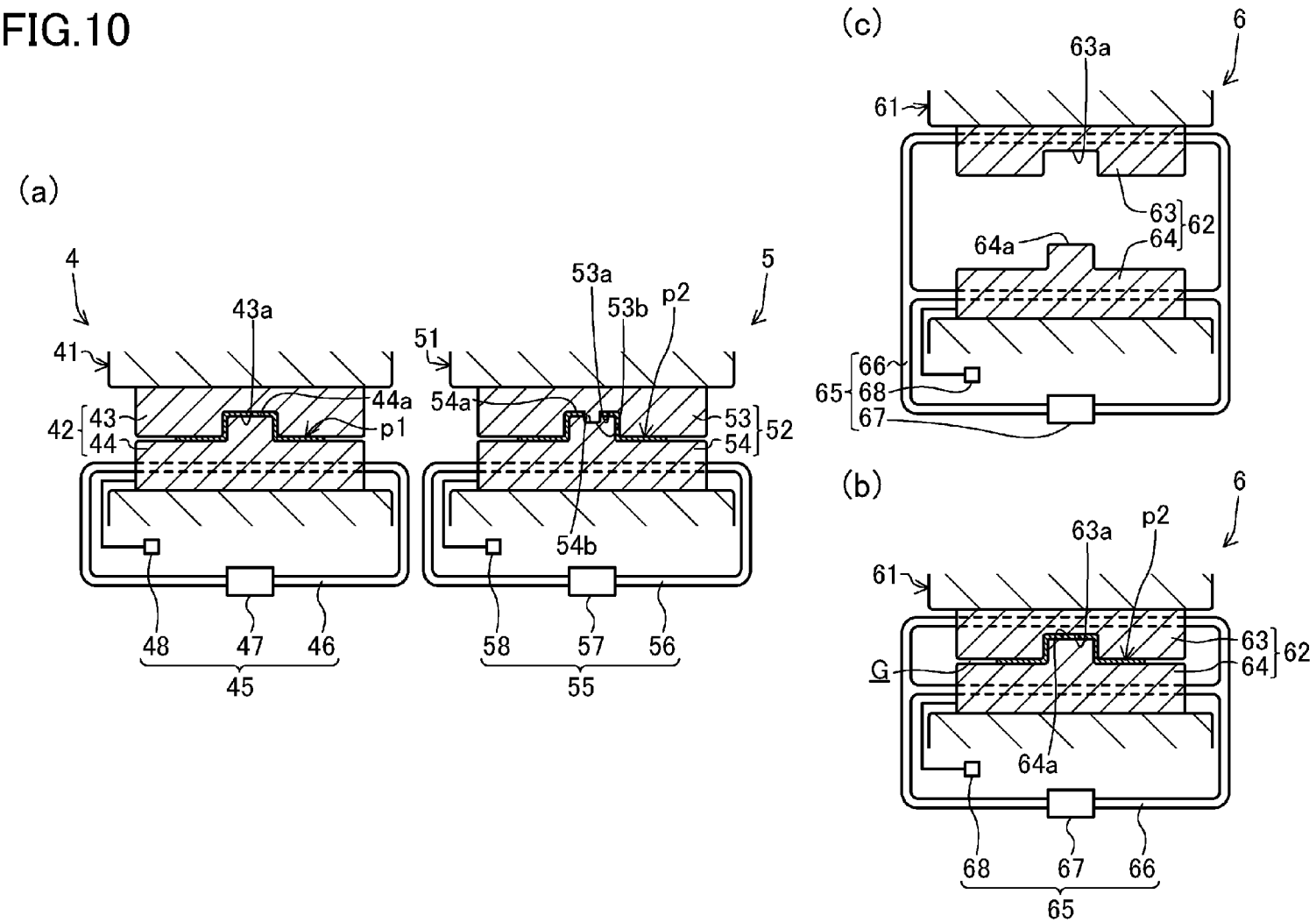
FIGS. 10(*a*)-10(*c*) illustrate a situation where the upper dies of the primary forming die set, the secondary forming die set, and the one of the cooling die sets are moved downward from their positions in FIG. 9 to plastically work the steel sheet with the primary forming die set, machine the primary formed product with the secondary forming die set, and cool (harden) the secondary formed product with the one of the cooling die sets.

First, as illustrated in FIGS. 10(*a*)-10(*c*), an upper die 43 of the primary forming die set 42 and an upper die 53 of the secondary forming die set 52 are moved down from their positions illustrated in FIG. 9(*a*) in synchronization with each other, and an upper die 63 of one of the cooling die sets 62 also moves down from its position illustrated in FIG. 9(*b*) at the same time as the upper dies 43 and 53. A primary formed product p1 is obtained from the steel sheet S with the primary forming die set 42, a secondary formed product p2 is obtained from the primary formed product p1 with the secondary forming die set 52, and the hardening of the secondary formed product p2 is started with the secondary formed product p2 held under pressure by the one of the cooling die sets 62.

Figure 11:
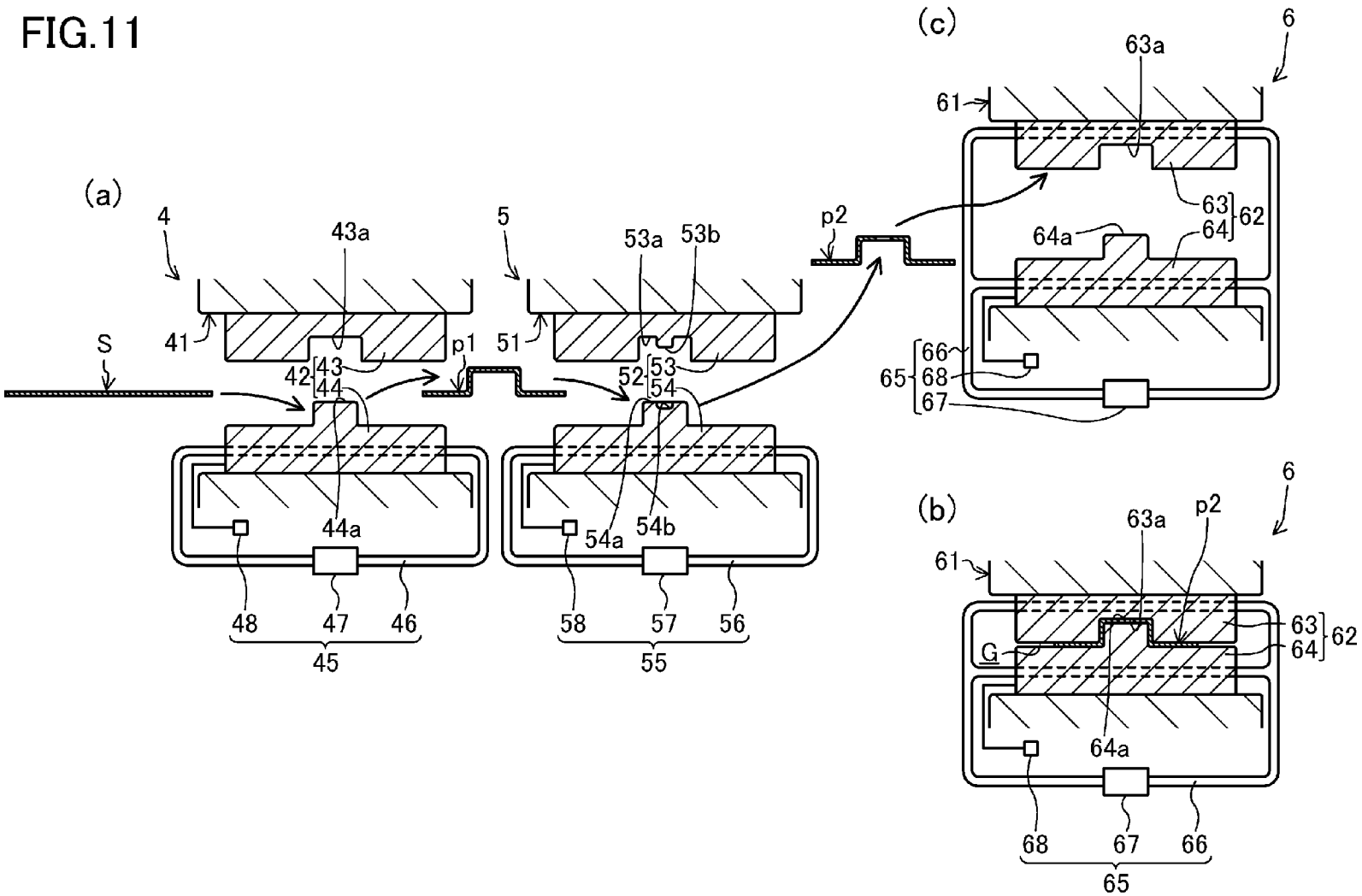
FIGS. 11(*a*)-11(*c*) illustrate a situation where while the upper dies of the primary and secondary forming die sets move upward from their positions in FIG. 10(*a*) so that primary and secondary formed products are separated from pressing surfaces of the corresponding die sets, the secondary formed product is removed from the secondary forming die set and carried into the other cooling die set, the primary formed product is removed from the primary forming die set and carried into the secondary forming die set, and a steel sheet is carried into the primary forming die set, the secondary formed product is cooled (hardened) with the one of the cooling die sets.

Next, as illustrated in FIGS. 11(*a*)-11(*c*), while the secondary formed product p2 is hardened with the upper die 63 of the one of the cooling die sets 62 moved down, the upper die 43 of the primary forming die set 42 and the upper die 53 of the secondary forming die set 52 move up in synchronization with each other without coordinating with the one of the cooling die sets 62; the primary formed product p1 plastically worked in the primary forming step 4 is separated from an upper pressing surface 43*a* of the upper die 43; and the secondary formed product p2 pierced in the secondary forming step 5 is separated from an upper pressing surface 53*a* of the upper die 53.

Next, the secondary formed product p2 is removed from the secondary forming die set 52 and carried into the other cooling die set 62 by the second robot R2, the primary formed product p1 is simultaneously removed from the primary forming die set 42 and carried into the secondary forming die set 52 by an automatic conveyor (not shown), and the steel sheet S is then removed from the heating furnace 30 and carried into the primary forming die set 42 by an automatic conveyor (not shown).

Figure 12:
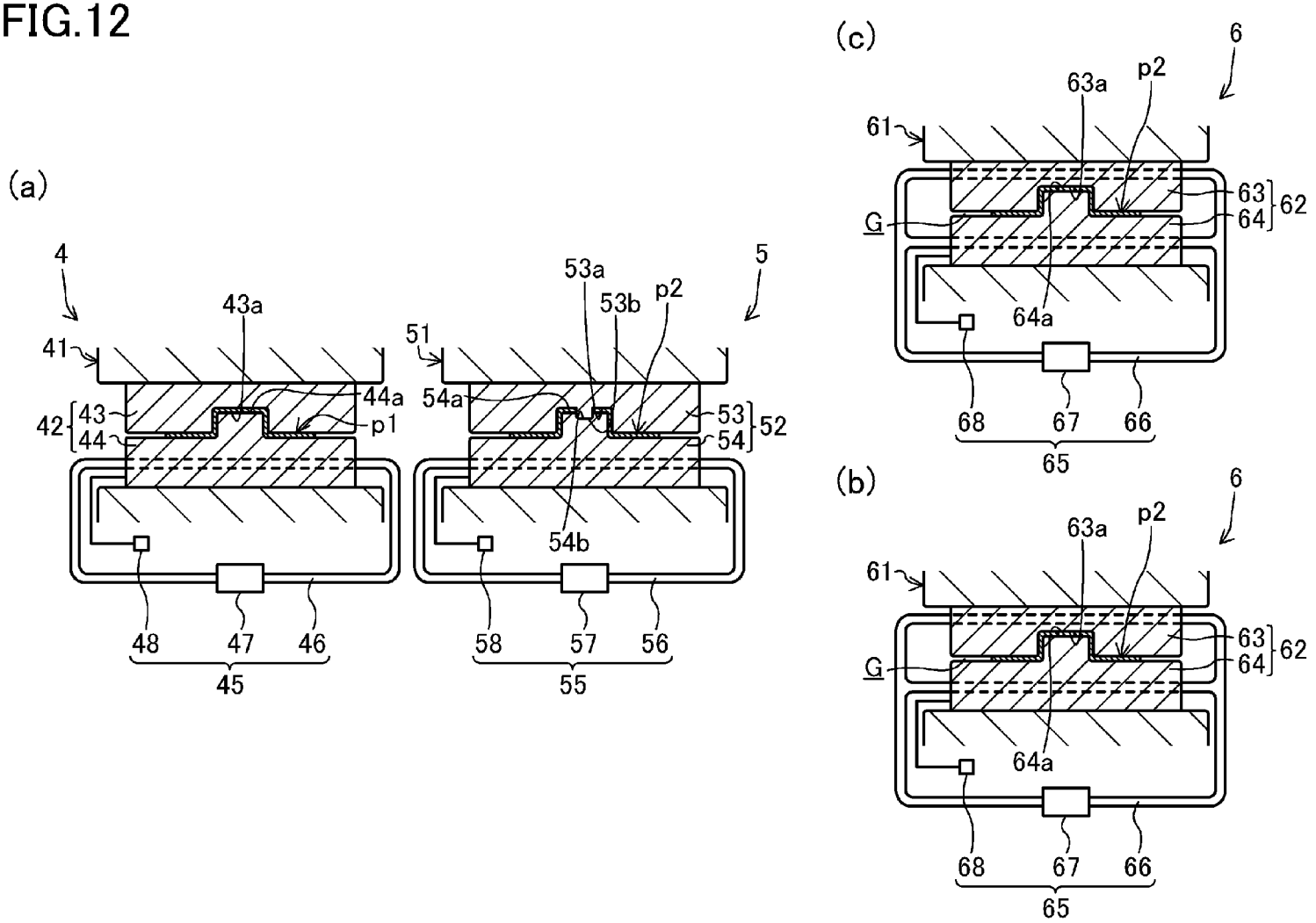
FIGS. 12(*a*)-12(*c*) illustrate a situation where the upper dies of the primary forming die set, the secondary forming die set, and the other cooling die set are moved downward from their positions in FIGS. 11(*a*) and 11(*c*) to plastically work the steel sheet with the primary forming die set, machine the primary formed product with the secondary forming die set, and cool (harden) the secondary formed product with the other cooling die set.

Subsequently, as illustrated in FIGS. 12(*a*)-12(*c*), the upper die 43 of the primary forming die set 42 and the upper die 53 of the secondary forming die set 52 are moved down in synchronization with each other, and an upper die 63 of the other cooling die set 62 also moves down at the same time as the upper dies 43 and 53; thus, a primary formed product p1 is obtained from the steel sheet S with the primary forming die set 42, a secondary formed product p2 is obtained from the primary formed product p1 with the secondary forming die set 52, and the hardening of the secondary formed product p2 is started with the secondary formed product p2 held under pressure by the other cooling die set 62.

Figure 13:
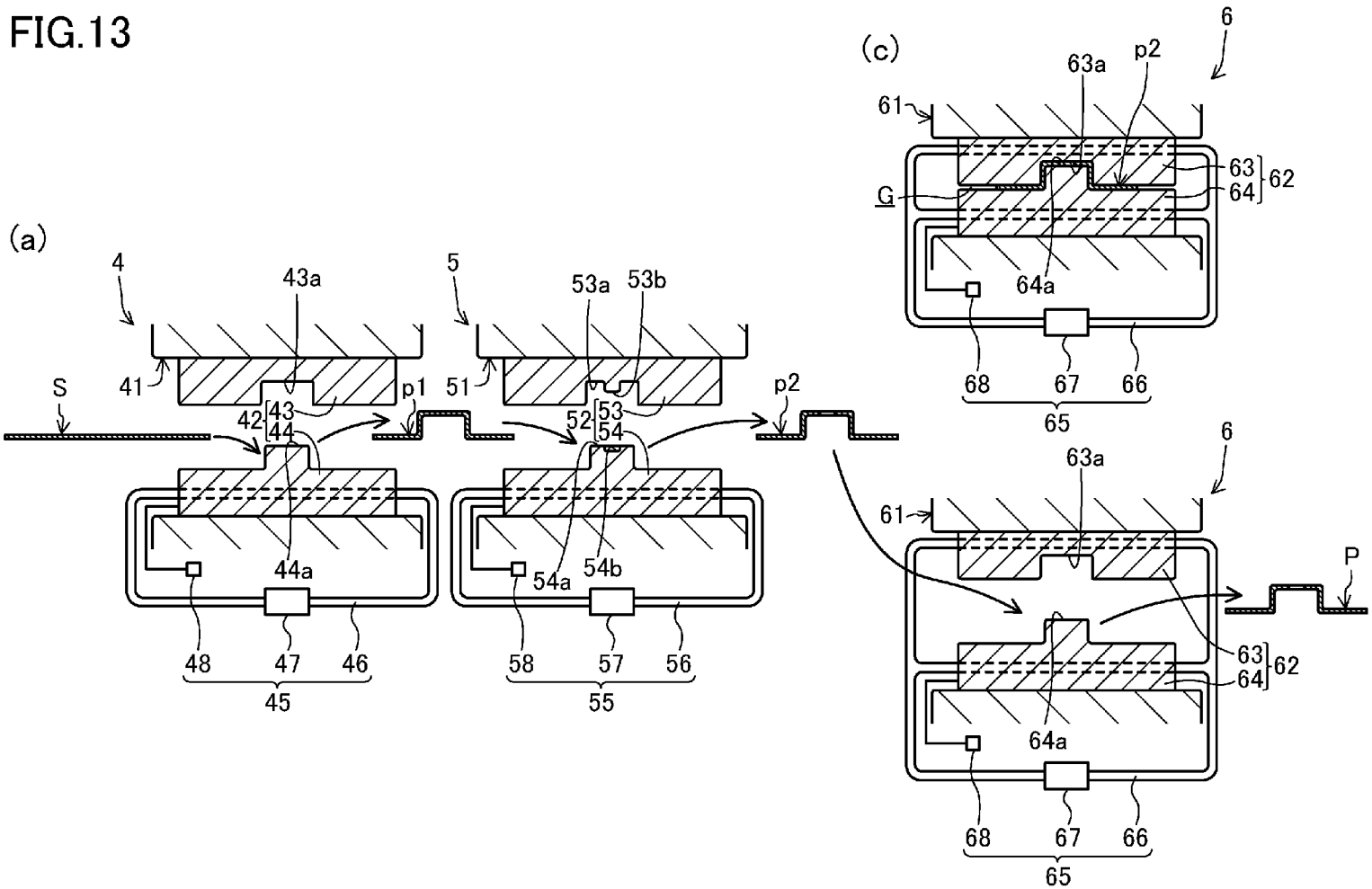
FIGS. 13(*a*)-13(*c*) illustrate a situation where the upper dies of the primary forming die set, the secondary forming die set, and the one of the cooling die sets move upward from their positions in FIGS. 12(*a*) and 12(*b*), a final formed product is removed from the one of the cooling die sets, the secondary formed product is removed from the secondary forming die set and carried into the one of the cooling die sets, the primary formed product is removed from the primary forming die set and carried into the secondary forming die set, and a steel sheet is carried into the primary forming die set.

Next, as illustrated in FIGS. 13(*a*)-13(*c*), while the secondary formed product p2 is hardened with the upper die 63 of the other cooling die set 62 moved down, the upper die 43 of the primary forming die set 42 and the upper die 53 of the secondary forming die set 52 move up in synchronization with each other without coordinating with the other cooling die set 62. Hardening is finished in the one of the cooling die sets 62 to obtain a final formed product P, and the upper die 63 of the one of the cooling die sets 62 also moves up at the same time as the upper dies 43 and 53.

Subsequently, the final formed product P is removed from the one of the cooling die sets 62 by the third robot R3, the secondary formed product p2 is simultaneously removed from the secondary forming die set 52 and carried into the one of the cooling die sets 62 by the second robot R2, the primary formed product p1 is simultaneously removed from the primary forming die set 42 and carried into the secondary forming die set 52 by an automatic conveyor (not shown), and the steel sheet S is then removed from the heating furnace 30 and carried into the primary forming die set 42 by an automatic conveyor (not shown). As such, a primary forming step 4, a secondary forming step 5, and two hardening steps 6 are successively performed in sequence, thereby obtaining final formed products P on the production line.

As above, according to the second embodiment of the present invention, while a secondary formed product p2 is cooled with one of cooling die sets 62, subsequent primary and secondary formed products p1 and p2 are obtained with primary and secondary forming die sets 42 and 52, respectively, thereby doubling production through the entire production line 1 without increasing the number of primary forming die sets 42 and the number of secondary forming die sets 52 to achieve a compact production line 1 providing high productivity.

Figure 14:
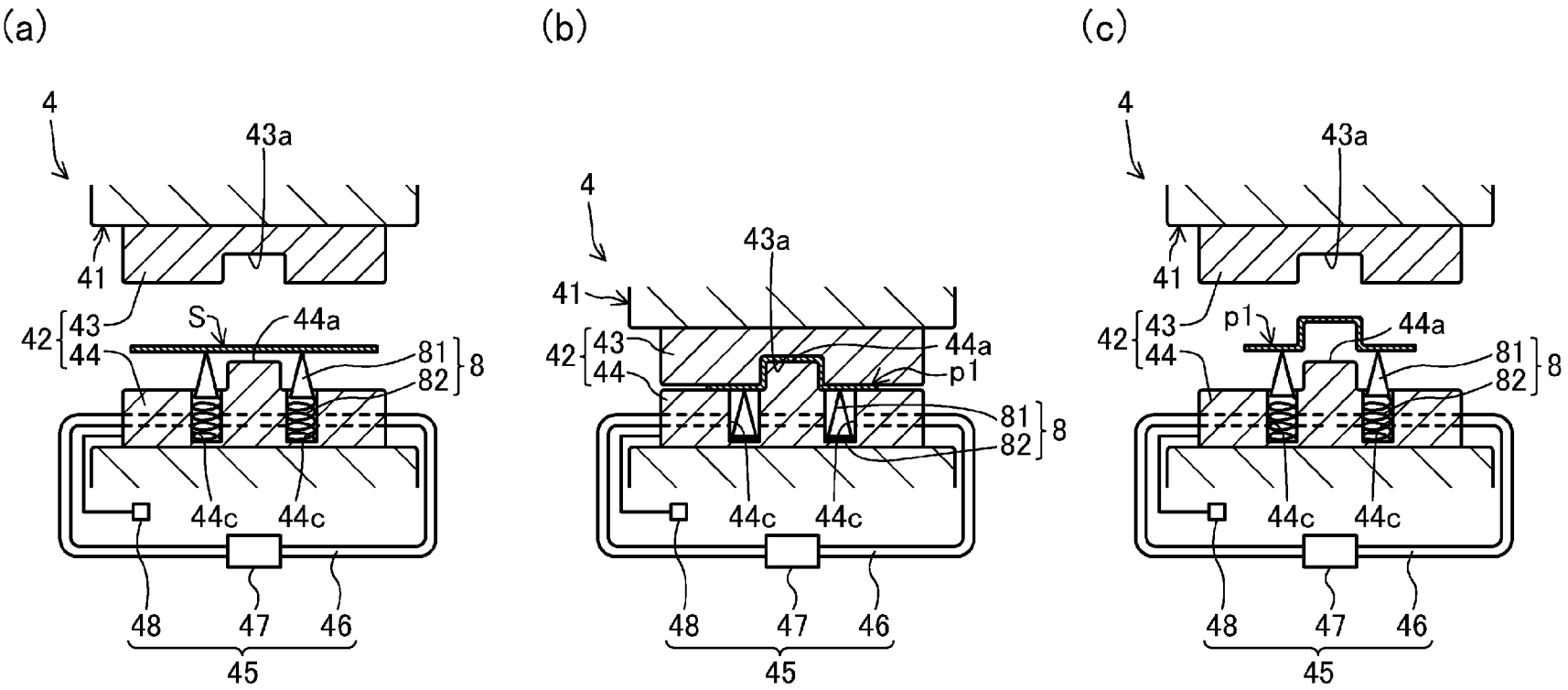
FIG. 14(*a*) is a diagram corresponding to a portion of FIG. 3, and illustrating only a primary forming die set for use in a forming method according to a third embodiment of the present invention, FIG. 14(*b*) illustrates a situation where an upper die of the primary forming die set is moved downward from its position in FIG. 14(*a*) to plastically work a steel sheet, and FIG. 14(*c*) illustrates a situation where the upper die of the primary forming die set moves upward from its position in FIG. 14(*b*) so that a primary formed product is separated from pressing surfaces of both of the upper die and a lower die of the primary forming die set.

FIGS. 14(*a*)-14(*c*) illustrate a primary forming die set 42 for use in a production line 1 according to a third embodiment of the present invention. In the third embodiment, only the structure of a lower die 44 of the primary forming die set 42 is different from that in the first embodiment, and the other elements are identical with those in the first embodiment; thus, only the difference between the third and first embodiments will be described hereinafter in detail.

A plurality of vertically extending recesses 44*c* are formed in the lower die 44 of the third embodiment, and each contain a separator 8.

The separator 8 includes a supporting member 81 formed in the shape of a generally triangular pyramid, and a coil spring 82 for urging the supporting member 81 upward.

As illustrated in FIG. 14(*a*), the supporting member 81 is urged upward by the coil spring 82 with the primary forming die set 42 opened, and protrudes upwardly beyond a lower pressing surface 44*a*. The supporting member 81 supports a steel sheet S carried from a heating furnace 30 to lift the steel sheet S, thereby separating the steel sheet S from the lower pressing surface 44*a*.

As illustrated in FIG. 14(*b*), the supporting member 81 is pressed downward by the steel sheet S (an upper die 43) with the primary forming die set 42 closed, and thus, descends against the spring force of the coil spring 82 so as to be contained in the recess 44*c*.

Furthermore, as illustrated in FIG. 14(*c*), the supporting member 81 is urged upward by the coil spring 82 with the primary forming die set 42 opened, and thus, protrudes upwardly beyond the lower pressing surface 44*a*. The supporting member 81 lifts a primary formed product p1 to separate the primary formed product p1 from the lower pressing surface 44*a*.

A method for manufacturing a final formed product P from a steel sheet S by hot pressing along the production line 1 of the third embodiment is identical with that in the first embodiment except that the steel sheet S carried into the opened primary forming die set 42 is lifted by the supporting member 81 so as to be separated from the lower pressing surface 44*a*, that the supporting member 81 is contained in the recess 44*c* in synchronization with the closing of the primary forming die set 42, and that the primary formed product p1 is lifted by the supporting member 81 in synchronization with the opening of the primary forming die set 42 so as to be separated from the lower pressing surface 44*a*; therefore, detailed description thereof is omitted.

As such, according to the third embodiment of the present invention, when a secondary formed product p2 is held under pressure by a cooling die set 62, the primary formed product p1 formed with the primary forming die set 42 is never in contact with both the pressing surface 43*a* of the upper die 43 of the primary forming die set 42 and the pressing surface 44*a* of the lower die 44 thereof. This ensures the prevention of the heat release from both the pressing surface 43*a* of the upper die 43 and the pressing surface 44*a* of the lower die 44, and avoids a situation where the temperature of the secondary formed product p2 becomes lower than the temperature at which hardening starts, thereby further reducing the energy consumed by, e.g., such a heating process for increasing the temperature of the primary formed product p1 as in Japanese Patent Publication No. 2007-136533 (paragraph 0028, FIG. 1) to reduce the running cost.

Although, in the third embodiment of the present invention, the lower die 44 of the primary forming die set 42 includes the plurality of separators 8, a lower die 54 of a secondary forming die set 52 may include a plurality of separators 8, and thus, the primary formed product p1 or the secondary formed product p2 may be separated from a lower pressing surface 54*a*.

Although the separators 8 of the third embodiment each include the single supporting member 81 and the single coil spring 82, components of each of the separators 8 are not limited to the above components. For example, a bar-shaped member having a front end including a suction cup may be protruded downward from each of the upper dies 43 and 53, and the primary and secondary formed products p1 and p2 may be drawn by the suction cup and suspended from the upper dies 43 and 53 so as to be each separated from a corresponding one of the upper pressing surfaces 43*a* and 53*a* and a corresponding one of the lower pressing surfaces 44*a* and 54*a*.

Furthermore, although the separators 8 according to the third embodiment of the present invention each move the supporting member 81 up and down by extending and contracting the coil spring 82, a method for moving the supporting member 81 up and down is not limited to the above method. For example, a cylinder extending or contracting in synchronization with the opening and closing of each of the primary and secondary forming die sets 42 and 43 may be used.

The invention claimed is:

1. A method for forming a steel sheet by hot pressing, the method comprising the steps of:

a primary forming step of obtaining a primary formed product by performing plastic working in which a heated steel sheet is pressed by upper and lower dies of a primary forming die set for a predetermined time period so as to be plastically deformed along a pressing surface of each of the upper and lower dies;

a secondary forming step of carrying the primary formed product into a secondary forming die set, and machining the primary formed product with upper and lower dies of the secondary forming die set for a predetermined time period to obtain a secondary formed product; and at least one hardening step of carrying the secondary formed product into a cooling die set placed in a hydraulic press controlled by a servomotor, and allowing upper and lower dies of the cooling die set to hold the secondary formed product under pressure for a longer time period than the time period of each of the primary and secondary forming steps to obtain a hardened final formed product, wherein:

the primary forming step, the secondary forming step, and the at least one hardening step are successively performed in sequence, the at least one hardening step is configured so as to be performed independently without coordinating with the primary and secondary forming steps, at least one of the primary or secondary forming die sets includes a temperature adjuster including a pipe inside the at least one of the primary or secondary forming die sets, a driver configured to circulate a heating medium through the pipe, and a temperature sensor connected to the at least one of the primary or secondary forming die sets, at a production start time at which production starts on a production line including the primary and secondary forming die sets and the cooling die set, adjusting a temperature of the heating medium circulating through the pipe of the temperature adjuster so as to increase a temperature of at least one of the primary or secondary forming die sets to a temperature at which hardening of the secondary formed product starts while sensing the temperature of the at least one of the primary or secondary forming die sets via the temperature sensor, and after increasing the temperature to the temperature at which hardening of the secondary formed product starts and between a start of hardening and an end of the hardening in the at least one hardening step:

the primary and secondary forming steps are both completed, the primary and secondary forming die sets are opened, the primary formed product plastically worked in the primary forming step and the secondary formed product machined in the secondary forming step are subsequently each separated from a pressing surface of at least one of the upper or lower die of a corresponding one of the die sets, and the temperature of the at least one of the primary or secondary forming die sets is adjusted by adjusting, via the temperature sensor, the temperature of the heating medium circulation through the pipe while sensing, via the temperature sensor, the temperature of the at least one of the primary or secondary forming die sets such that:

when the temperature of the at least one of the primary or secondary forming die sets is lower than the temperature at which the hardening of the secondary formed product starts, the temperature of the at least one of the primary or secondary forming die sets is increased; and when the temperature of the at least one of the primary or secondary forming die sets is higher than the temperature at which the hardening of the secondary formed product starts, the temperature of the at least one of the primary or secondary forming die sets is decreased.

2. The method of claim 1, wherein:

the primary and secondary forming die sets operate in synchronization with each other by using corresponding mechanical presses.

3. The method of claim 2, wherein:

the at least one hardening step comprises two hardening steps, while the secondary formed product is cooled with the corresponding cooling die set in one of the two hardening steps, a secondary formed product subsequently machined with the secondary forming die set is carried into the corresponding cooling die set so as to be cooled in the other one of the two hardening steps, and while the secondary formed product is subsequently cooled with the corresponding cooling die set in the other one of the two hardening steps, a hardened final formed product is removed from the corresponding cooling die set in the one of the two hardening steps.

4. The method of claim 1, wherein:

at least one of a lower die of the primary forming die set in the primary forming step or a lower die of the secondary forming die set in the secondary forming step includes a plurality of separators, the separators each include:

a supporting member having a sharp upper end, and an urging mechanism configured to urge the supporting member upwardly, and between a start of hardening and an end of the hardening in the hardening step, while the primary and secondary forming die sets are opened, a biasing force of the urging mechanism allows the supporting member to protrude upwardly beyond a pressing surface of the at least one of the lower die of the primary forming die set and the lower die of the secondary forming die set so that the at least one of the primary or secondary formed product is separated from both a pressing surface of the corresponding upper die and a pressing surface of the corresponding lower die by being lifted from the pressing surface of the corresponding lower die.

5. The method of claim 1, wherein:

the temperature adjuster including the pipe inside the at least one of the primary or secondary forming die sets and the driver configured to circulate the heating medium through the pipe is a forming die temperature adjuster, the cooling die set includes a cooling die set temperature adjuster including a pipe inside the cooling die set and a driver configured to circulate cold water through the pipe of the cooling die set temperature adjuster, and after the at least one hardening step has been completed and the cooling die set has been opened, a temperature of cold water circulating through the pipe of the cooling die set temperature adjuster is adjusted such that the cooling die set is decreased to a set temperature for hardening.

* * * * *